US006637855B2

(12) United States Patent
Ide et al.

(10) Patent No.: US 6,637,855 B2
(45) Date of Patent: Oct. 28, 2003

(54) LIQUID DISCHARGE APPARATUS AND DISCHARGE RECOVERY METHOD THEREFOR

(75) Inventors: Daisaku Ide, Tokyo (JP); Akitoshi Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/994,733

(22) Filed: Nov. 28, 2001

(65) Prior Publication Data

US 2002/0085062 A1 Jul. 4, 2002

(30) Foreign Application Priority Data

Nov. 30, 2000 (JP) ..... 2000/364722

(51) Int. Cl.[7] ..... B41J 2/165
(52) U.S. Cl. ..... 347/23; 347/33
(58) Field of Search ..... 347/23, 29, 30, 347/33, 14

(56) References Cited

FOREIGN PATENT DOCUMENTS

| | | |
|---|---|---|
| EP | 0 621 136 | 10/1994 |
| EP | 0 953 448 | 11/1999 |
| EP | 1 029 684 | 8/2000 |
| JP | 59-045161 | 3/1984 |
| JP | 7-148934 | 6/1995 |
| JP | 11-342620 | 12/1999 |

OTHER PUBLICATIONS

EP Search Report dated Mar. 22, 2002, De Groot, R.

U.S. application No. 09/994,735, filed Nov. 28, 2001, Pending.

*Primary Examiner*—Shih-Wen Hsieh
(74) *Attorney, Agent, or Firm*—Fitzpatrick, Cella, Harper & Scinto

(57) ABSTRACT

A liquid discharge apparatus comprises an energy generating element for generating energy to be utilized for discharging liquid, a wiper for wiping in succession plural discharge ports for discharging liquid, utilizing the energy generated by the energy generating element, control device for starting liquid discharge, utilizing the energy generated by the energy generating element, among the plural discharge ports, in succession from a discharge port immediately prior to being wiped by the wiper and from a discharge port in the vicinity of the immediately prior discharge port at the downstream side in the wiping direction by the wiper.

10 Claims, 11 Drawing Sheets

LIQUID DISCHARGE APPARATUS AND DISCHARGE RECOVERY METHOD THEREFOR

BACKGROUND OF THE INVENTION

1. Field of the Invention

The present invention relates to a liquid discharge apparatus such as an ink jet recording apparatus and a discharge recovery method therefor.

2. Related Background Art

For the recording apparatus such as a printer, a copying apparatus or a facsimile, and the recording apparatus (printing apparatus) used as the output device for the composite electronic equipment such as a computer or a word processor and for the work stations, there is popularly adopted the liquid discharge apparatus such as an ink jet recording apparatus for executing recording by discharging ink toward a recording medium such as paper, cloth, plastic sheet or OHP sheet. There are also various requirements for the material of such recording medium. There have recently been developments to meet such requirements, and the liquid discharge apparatus is not being used not only for ordinary recording paper (including thin paper and coated paper) or thin plastic plate (such as OHP sheet) but also for cloth, leather, non-woven cloth or even metal.

The aforementioned liquid discharge apparatus (for example ink jet recording apparatus) provides various advantages such as a low noise level, a low running cost, easy compactization of the apparatus and ease of color recording, and is therefore widely employed in the printer, copying apparatus, facsimile etc. On the front face of a liquid discharge head (ink jet recording head) of the liquid discharge apparatus, there is formed a discharge port (usually in plural units), of which size is generally about several tens of microns but is recently becoming smaller with the progress in image quality. A liquid droplet is discharged from the discharge port based on a discharge signal processed in the apparatus according to liquid discharge information (recording data) supplied from a host equipment, thereby forming an image (including a character or a symbol) on the recording medium.

In the aforementioned ink jet recording apparatus executing a recording operation by discharging ink from recording means onto the recording medium, since the recording is executed by discharging ink from a minute discharge port, there may result clogging in the discharge port to lead to defective discharge (including lack of discharge) thereby deteriorating the quality of the recorded image. As a countermeasure for such phenomenon, there is being employed a recovery unit for maintaining and recovering the ink discharge ability of the recording means. The currently employed recovery unit is for example provided with a capping mechanism for capping the discharge port of the recording head, suction means connected to the capping mechanism in the capped state and generating a negative pressure therein by the function of a pump to discharging viscosified ink or bubbles from the discharge port thereby refreshing the ink in the discharge port and maintaining and recovering the ink discharge ability, and wiping means for wiping off ink etc. deposited on the discharge port face of the recording means to achieve cleaning thereof.

In the aforementioned wiping means, in order to maintain the performance of the ink jet head constituting the liquid discharge means to be mounted on the ink jet recording apparatus constituting the liquid discharge apparatus, there is widely employed technology of cleaning the discharge port face, including the discharge port, with a wiper after a predetermined pause of the liquid discharge means following the liquid discharge of a predetermined amount therefrom or after a suction operation for eliminating the bubble or dust in the liquid discharge means. In such technology, there is proposed a method of discharging liquid (ink) from the discharge port when the wiper blade passes the discharge port in order to increasing the cleaning ability of the wiper (such liquid discharge being hereinafter called preliminary discharge).

For example the Japanese Patent Application Laid-open No. 59-45161 discloses a technology, in case of wiping the discharge port face including plural discharge ports in a direction of array of the discharge ports, of forming a discharge port not used in the image formation (recording of character etc.) at the upstream side of the wiping direction, and executing the wiping operation while discharging ink from such discharge port or executing the wiping operation while discharging ink not only from such discharge port but also from the discharge ports involved in the image formation. Also the Japanese Patent Application Laid-open No. 7-148934 discloses a technology of wetting the wiper by discharging ink thereto and eliminating the smear with thus wetted blade. Also the Japanese Patent Application Laid-open No. 11-342620 discloses a technology, in case of wiping the discharge port face including plural discharge ports in a direction perpendicular to the direction of array of the discharge ports, of improving the smear eliminating ability by utilizing ink discharge in parallel.

However, in case of executing the wiping operation in the direction of array of the discharge ports, it is found that the method of wiping after wetting the wiper in advance or the method of forming a discharge port not used for image formation at the upstream side of the wiping direction and executing the wiping direction while discharging ink from such discharge port may not be sufficient for eliminating the tough smear on the discharge port face. It is therefore conceivable to execute the wiping operation while discharging liquid (ink) from all the discharge ports, but such method requires a large amount of preliminary discharge even outside the contact area of the wiper blade with the discharge port face, thereby leading to drawbacks of smearing the main body of the liquid discharge apparatus (printing apparatus etc.) and unnecessarily large consumption of ink.

SUMMARY OF THE INVENTION

In consideration of the foregoing, the object of the present invention is to provide a liquid discharge apparatus capable of sufficiently cleaning the discharge port face while minimizing the consumption of liquid, and a discharge recovery method for such apparatus. The present invention is to control the position of the discharge port executing liquid discharge and the discharging condition thereof according to the position of the wiper in the course of the wiping operation, thereby optimizing the position and condition of liquid discharge according to the purpose of wiping.

The liquid discharge apparatus of the present invention comprises energy generating elements for generating energy to be utilized for liquid discharge, a wiper for wiping in succession plural discharge ports which discharge liquid utilizing the energy generated by the energy generating element, and control means for starting liquid discharge in succession, among the aforementioned plural discharge ports, from a discharge port immediately prior to being wiped by the wiper and a discharge port in the vicinity of the aforementioned immediately prior discharge port at the downstream side in the wiping direction of the wiper. Such liquid discharge apparatus of the present invention controls the position of the discharge port executing the liquid discharge and the discharge condition thereof according to the position of the wiper in the course of wiping operation to optimize the position and condition of the liquid discharge according to the purpose of the wiping, thereby sufficiently cleaning the discharge port face while minimizing the liquid consumption.

Also the discharge recovery method of the present invention for the liquid discharge apparatus comprises a wiping step of wiping, with a wiper, in succession plural discharge ports which discharge liquid utilizing the energy generated by energy generating elements which generate energy to be utilized for liquid discharge, and a discharge step of starting liquid discharge in succession, among the aforementioned plural discharge ports, from a discharge port immediately prior to being wiped by the wiper and a discharge port in the vicinity of the aforementioned immediately prior discharge port at the downstream side in the wiping direction of the wiper. Such discharge recovery method of the present invention for the liquid discharge apparatus controls the position of the discharge port executing the liquid discharge and the discharge condition thereof according to the position of the wiper in the course of wiping operation to optimize the position and condition of the liquid discharge according to the purpose of the wiping, thereby sufficiently cleaning the discharge port face while minimizing the liquid consumption.

DESCRIPTION OF THE PREFERRED EMBODIMENTS

Figure 1:
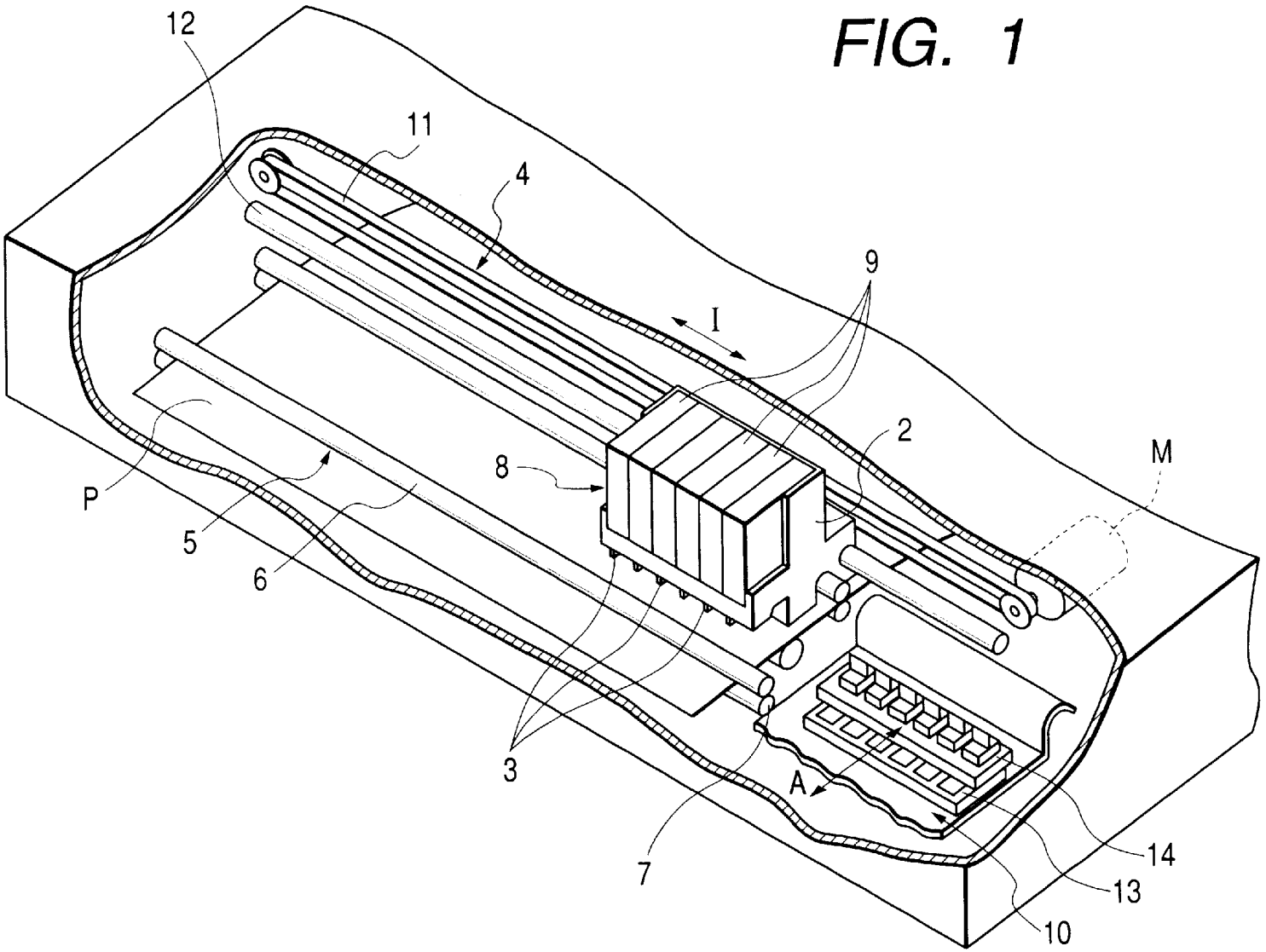
FIG. 1 is a schematic perspective view showing an example of an ink jet recording apparatus constituting the liquid discharge apparatus of the present invention.

Now the present invention will be clarified in detail by embodiments thereof, with reference to the accompanying drawings. FIG. 1 is a schematic perspective view showing an embodiment of an ink jet recording apparatus constituting the liquid discharge apparatus of the present invention, wherein a recording medium (recording paper) P is conveyed (paper feeding) by a conveying roller (paper feeding roller) 6 of a conveying mechanism (paper feeding mechanism) 5 and is subjected to image formation (recording) on a platen (a platen roller in the illustrated example) 7 by liquid (ink) discharge from recording means (recording head) 3 constituting liquid discharge means according to discharge information (recording information etc.). In the illustrated example, the recording means is composed of plural recording heads 3 for discharging respectively different inks, and such recording heads 3 are positioned and mounted on a carriage 2. The aforementioned plural discharge heads (recording heads) 3 are connected to ink tanks 9 filled with respectively corresponding inks. In the illustrated example, there are employed plural (six) cartridges 8 for executing recording with different inks, and each cartridge 8 integrally includes the recording head (recording means) 3 and the ink tank 9 and is replaceably mounted.

The carriage 2 is guided and supported by a guide shaft 12 provided in the main body of the apparatus, so as to be capable of a reciprocating motion in a direction I. The carriage 2 is connected to a driving belt 11 of a carriage driving mechanism 4, and is driven along the guide shaft 12 by the driving power of a carriage motor M. Consequently the carriage 2 executes a reciprocating motion along the guide shaft 12 by the forward and reverse rotations of the carriage motor M, and is controlled in position and in movement (in the main scanning direction) by the control of rotation of the carriage motor M. An unrepresented conveying motor drives the conveying roller 6 of the aforementioned conveying mechanism 5 through an unrepresented transmission mechanism, thereby conveying (paper feeding, sub scanning) of the recording medium (recording paper) P.

The recording head (recording means) 3 constituting the liquid discharge means (liquid discharge head) is ink jet recording means utilizing thermal energy for ink discharge, and is provided with an electrothermal converting member for generating thermal energy. The recording head 3 discharges liquid from a discharge port utilizing a pressure change (state change) resulting from growth and contraction of a bubble generated by film boiling induced by the thermal energy applied by the electrothermal converting element, thereby executing recording.

Figure 2:
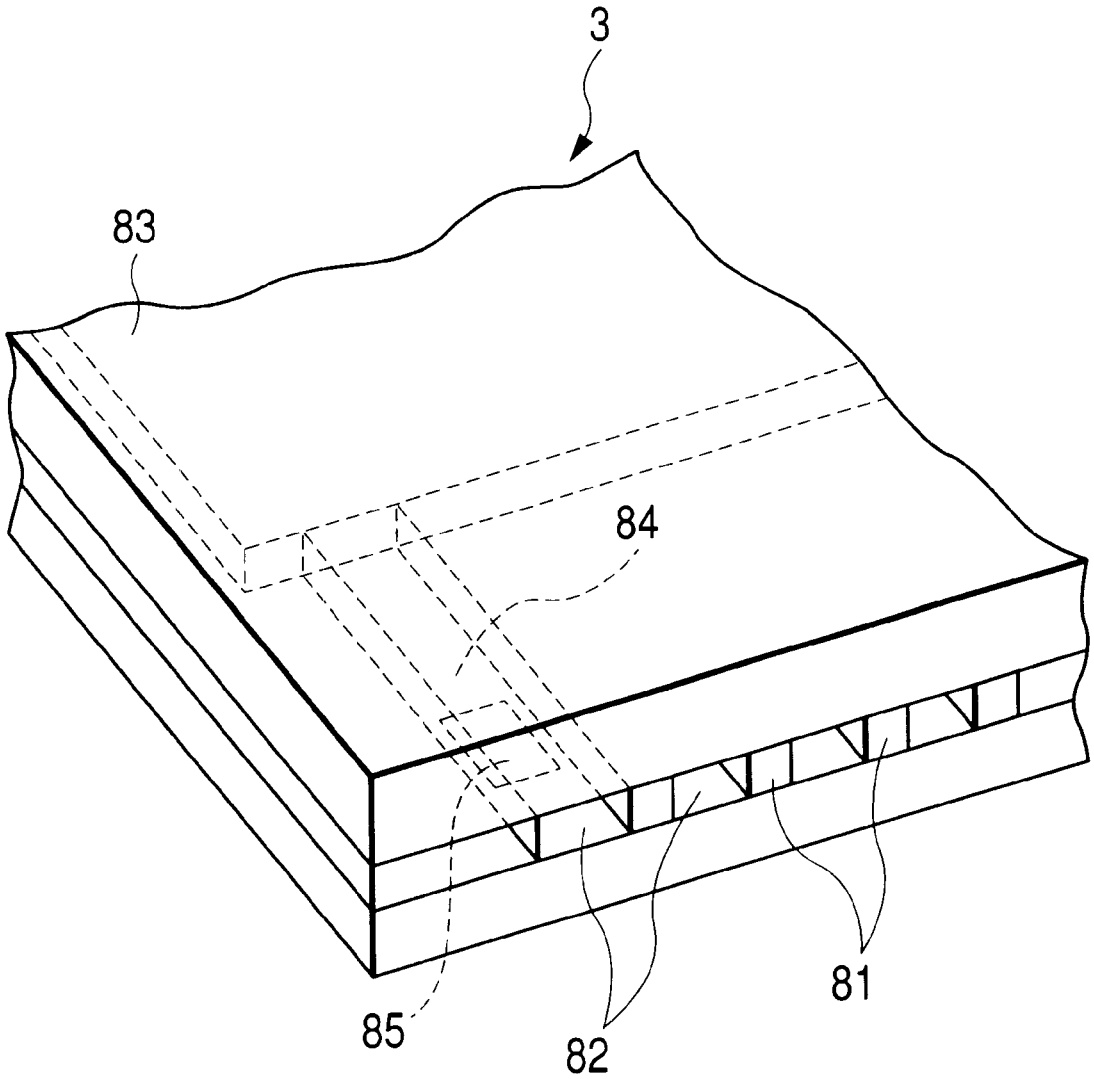
FIG. 2 is a partial perspective view schematically showing the configuration of an ink discharge portion of a recording head constituting the discharge means in FIG. 1.

FIG. 2 is a partial perspective view schematically showing the configuration of an ink discharge portion of the aforementioned recording head 3. Referring to FIG. 2, a discharge port face 81 opposed to the recording medium P with a predetermined gap (for example about 0.3 to 2.0 mm) is provided with plural discharge ports 82 at a predetermined pitch, and an electrothermal converting member (for example heat generating resistor) 85 for generating ink discharging energy is provided along a wall of each of liquid paths 84 respectively connecting the discharge ports 82 with a common liquid chamber 83. In the present embodiment, the recording head 3 is mounted on the carriage 2 in such a positional relationship that the array of the discharge ports 82 crosses the scanning direction of the carriage 2. Thus, in the recording head 3, an image signal or a discharge signal drives the corresponding electrothermal converting member 85 to induce film boiling in the ink contained in the liquid path 84, thereby discharging ink from the discharge port 82 by a pressure generated by such film boiling.

Referring to FIG. 1, in a predetermined position (for example corresponding to a home position of the carriage 2) within the moving range of the carriage 2 but outside the recording area, there is provided a recovery system (recovery device) 10 for maintaining and recovering the ink discharge ability of the recording head 3 in a waiting state for the recording operation, or before or after the recording operation or at a suitable timing during the recording operation. The recovery system 10 is provided, for example, with a cap 13 for capping the discharge port face 81 of the recording head sitting in the home position, a suction pump (not shown) connected to the cap 13 and serving as a negative pressure source, wiping means consisting of a wiper 14 for wiping (cleaning) the discharge port face 81 of the recording head 3. The wiper 14 is usually formed as a plate-shaped member (blade) of a rubber-like elastic material.

In case of executing a recovery operation for maintaining and recovering the ink discharge ability of the recording head 3, the recovery system 10 executes a suction recovery operation of activating the suction pump while the cap 13 is maintained in close contact with the discharge port face 81 to cover the discharge ports 82 thereby sucking ink from the discharge ports 82 and discharging abnormal substances such as viscosified ink and bubbles together with the ink, thus restoring the normal state of the ink in the discharge ports, or, instead, a discharge recovery operation of forcedly discharging ink from the discharge ports 82 by pressurizing means provided for example in the ink supply paths toward the aforementioned cap 13 or another liquid receiver (not shown) thereby eliminating the viscosified ink or bubbles in the ink flow paths of the recording head 3. In a non-recording state such as after the end of the recording operation or in the waiting state for the recording operation, the recording head 3 is moved to the home position and the discharge port face is capped with the aforementioned cap 13 in order to protect the discharge port face 81 and to prevent the ink evaporation from the discharge port 82.

Also, in order to maintain the performance of the ink jet head constituting the liquid discharge means mounted on the ink jet recording head constituting the liquid discharge apparatus, there is provided wiping means for wiping (cleaning) abnormal substances such as liquid (ink etc.) and solid deposit adhered to the discharge port face 81 of the liquid discharge head 3 by means of the wiper 14. Such wiping operation is executed by wiping the discharge port face 81 including the discharge ports 82 with the wiper 14, for example after the lapse of a predetermined pause of the liquid discharge means following the liquid discharge of a predetermined amount, or after the execution of a suction operation for eliminating the bubbles and dusts in the liquid discharge means. In such operation, in order to improve the cleaning ability by the wiper 14, there is employed a technology of discharging liquid (ink) from the discharge port 82 when the wiper blade passes the discharge port (such discharge being hereinafter called preliminary discharge).

Thus the present invention provides a liquid discharge apparatus comprising energy generating elements for generating energy to be utilized for liquid discharge, a wiper for wiping in succession plural discharge ports for discharging liquid by the energy generated by the energy generating elements, and control means for starting liquid discharge utilizing the energy generated by the energy generating elements in succession, among the plural discharge ports, from a discharge port immediately prior to being wiped by the wiper and a discharge port in the vicinity of the immediately prior discharge port at the downstream side in the wiping direction by the wiper.

Also the present invention provides a discharge recovery method for a liquid discharge apparatus, comprising a wiping step of wiping in succession plural discharge ports for discharging liquid by the energy generated by the energy generating elements for generating energy to be utilized for liquid discharge, and a discharge step of starting liquid discharge utilizing the energy generated by the energy generating elements in succession, among the plural discharge ports, from a discharge port immediately prior to being wiped by the wiper and a discharge port in the vicinity of the immediately prior discharge port at the downstream side in the wiping direction by the wiper.

Figure 3:
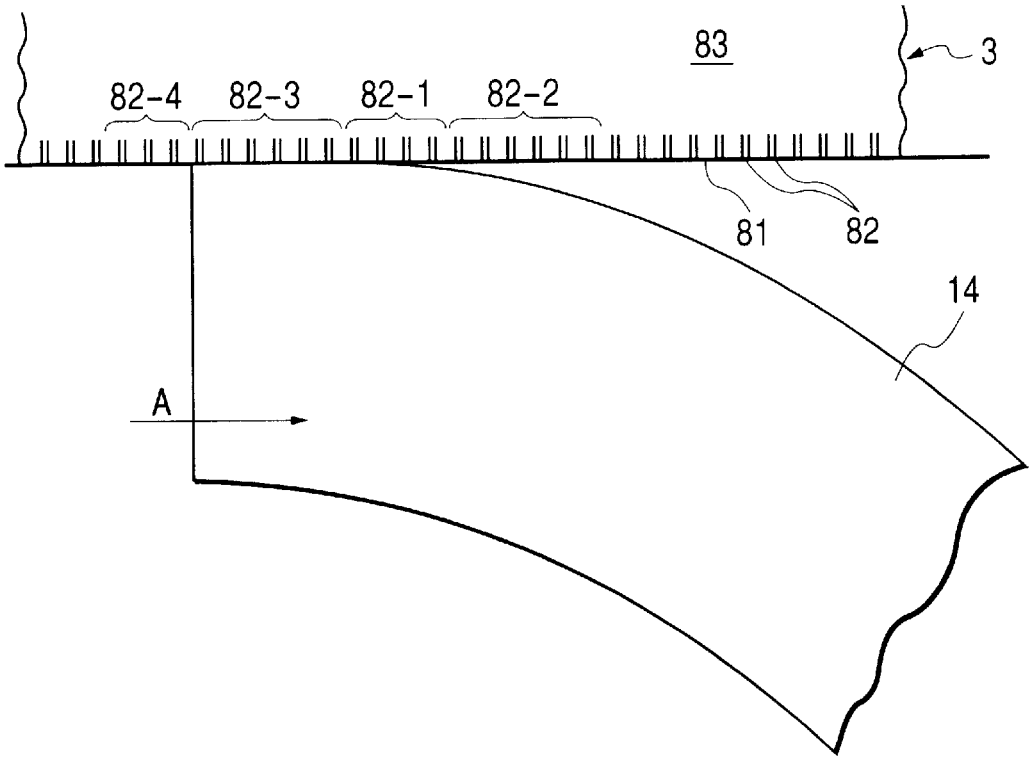
FIG. 3 is a partial longitudinal cross-sectional view of liquid discharge means schematically showing the discharge frequency of ink discharge and the control state on the position of the discharge port in the course of a wiping operation in the liquid discharge apparatus of the present invention.

In the following there will be given a detailed explanation on the configuration featuring the liquid discharge apparatus of the present invention and the discharge recovery method for the liquid discharge apparatus. FIG. 3 is a partial longitudinal cross-sectional view schematically showing the discharge frequency of ink discharge and the control state for the position of the discharge port in the course of the wiping operation in the liquid discharge apparatus of the present invention. Referring to FIG. 3, the liquid (ink) is discharged from the discharge ports of predetermined positions when the wiper (blade) 14 passes the array of the plural discharge ports 82.

More specifically, in the course of a wiping operation of the wiper 14 along the discharge port face 81, the plural discharge ports 82 constituting the discharge port array on the discharge port face 81 are so controlled as to start in succession the ink discharging operation with a predetermined frequency by the energy generated from the energy generating elements (for example the electrothermal converting elements 85) from the ports of predetermined positions, more specifically among the plural discharge ports 82 formed on the discharge port face 81, from a discharge port 82-1 immediately prior to being wiped by the wiper 14 and a discharge port 82-2 in the vicinity of the discharge port 82-1 at the downstream side in the wiping direction (A) by the wiper 14. Also there may be executed if necessary, in addition to the discharge from the aforementioned discharge ports 82-1, 82-2, discharge from a discharge port 82-3 in the contact area of the wiper 14 or discharge from a discharge port 82-4 immediately after passing of the wiper 14.

The discharge from the aforementioned discharge ports 82-1, 82-2 is to induce and maintain a liquid convection in a space between the wiper 14 and the discharge port face 81. More specifically, the liquid discharged from the discharge ports 82 at a predetermined frequency is made to collide with the surface of the wiper 14 to cause a reciprocating motion in the discharged liquid between the wiper 14 and the discharge port face 81 and to expel the abnormal substances wiped by (attached to) the end of the wiper 14 in a remote direction along the surface thereof, thereby securing the wiping performance and to re-deposit the liquid bouncing from the surface of the wiper 14 (clean liquid immediately after discharge), whereby the wetted state can be secured and the wiping ability can be improved.

Also the discharge from the discharge port 82-3 is to generate and maintain a liquid convection within the discharge port. Such convection within the discharge port agitates the abnormal substances in the liquid discharge (in the liquid flow path) and causes them to stay in the vicinity of the discharge port (entrance) thereby preventing the entry of such abnormal substances into the interior of the head. Also the discharge from the discharge port 82-4 is to discharge the abnormal substances and can securely eliminate such abnormal substances eventually present in or having entered the discharge port.

More specifically, in the discharge recovery method of the liquid discharge apparatus as shown in FIG. 3, the ink discharge from the discharge port induces a vigorous convection in the discharge port in the vicinity of the contact position of the wiper 14 and between the wiper 14 and the discharge port face 81 to sufficiently agitate the tough smear and dusts present in the interior of the discharge port and in the vicinity thereof thus improving and securing the cleaning effect by the wiping (sliding) operation of the wiper 14, and such ink discharge is executed with such a frequency as to secure elimination of such tough smear and dusts without pushing them into the discharge port.

Also the entire discharge port face 81 is well wetted with the discharged ink of a temperature much higher than the ambient temperature by the capillary force generated in the gap between the wiper 14 and the discharge port face 81, thereby re-dissolving the viscosified or solidified ink and thus improving the eliminating (cleaning) effect. In order to improving the wiping ability of the wiper 14, the control is so executed as to discharge the liquid (ink) under predetermined condition from the discharge ports in necessary predetermined positions.

Figure 4:
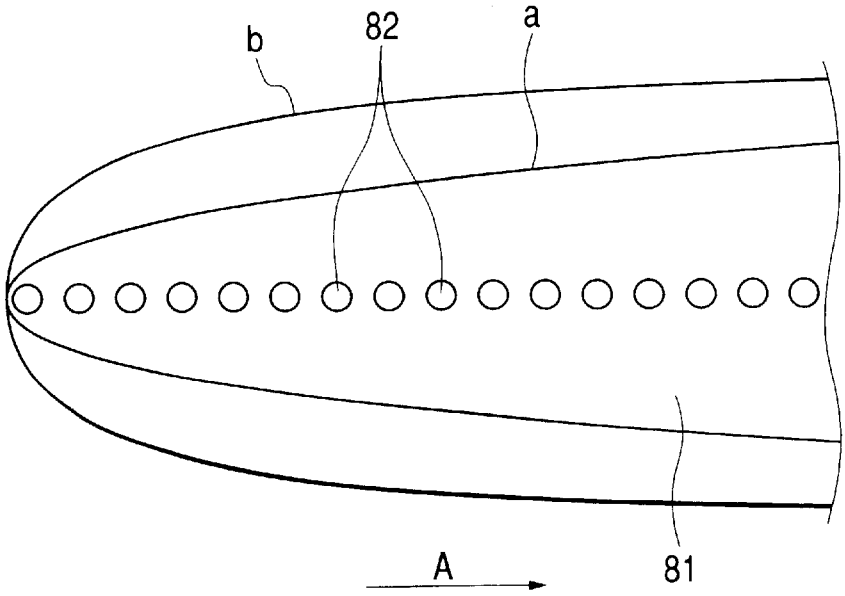
FIG. 4 is a partial elevation view of a discharge port face showing a wetted area in case of ink discharge from the discharge ports at the upstream side in the wiping direction, in comparison with a case without such ink discharge.

Also in the embodiment of the present invention, the position of the discharge ports executing ink discharge is limited to those in a predetermined area. FIG. 4 is a partial elevation view of the discharge port face, schematically showing the effect of ink discharge only from the discharge ports within a predetermined area at the upstream side in the wiping direction. In case of executing the wiping operation along the array of the discharge ports, the wiping speed is maintained at a certain constant speed or lower thereby extracting fresh ink from the discharge ports 82 and thus wetting the discharge port face 81. However, in case of wiping operation with the above-mentioned ink wetting without the ink discharge, the area covered by the fresh ink becomes narrower in the upstream side of the discharge port array in the wiping direction, as indicated by a curve a in FIG. 4. Therefore, by discharging ink only from the discharge ports of a predetermined area at the upstream side in the wiping direction, the area realizing the satisfactory cleaned state after wiping can be widened to the desired area as indicated by a curve b in FIG. 4, without causing excessive ink discharge (excessive ink consumption).

Figure 5A:
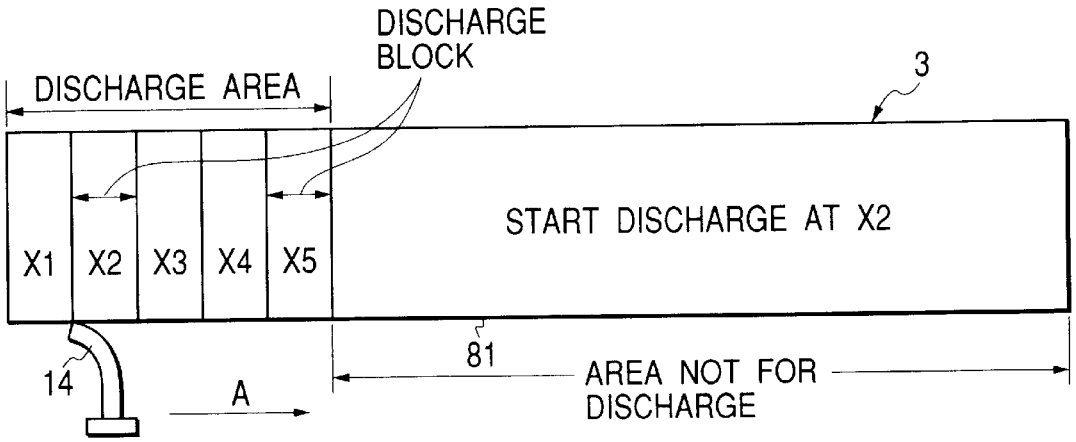
FIGS. 5A and 5B are lateral views schematically showing control states, in the unit of a block, of the position of the discharge ports executing ink discharge in the course of wiping operation, together with the position of the wiper.
Figure 5B:
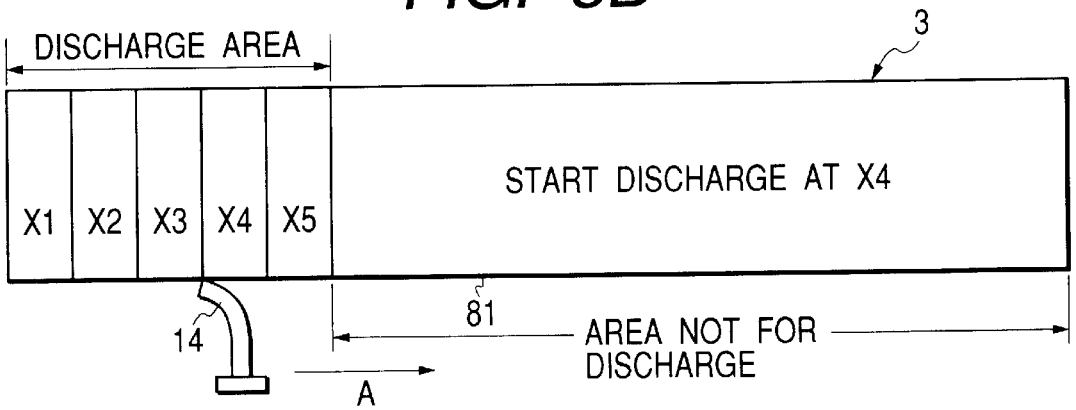

Also in the embodiment of the present invention, the control of changing the position of the discharge ports executing ink discharge according to the position of the wiper (wiping position) may be executed in the unit of a block. FIGS. 5A and 5B are lateral views schematically showing a state of controlling the position of the discharge ports executing ink discharge in the course of wiping operation in the unit of a block, together with the position of the wiper 14. In FIGS. 5A and 5B, in wiping the discharge port face 81 with the wiper 14, the ink is discharged, among the plural discharge ports 82 (for example 300 ports) provided in the discharge port face 81, from those in a predetermined area in the upstream side in the wiping direction A (for example 120 ports from the upstream end, constituting a discharge area), and the plural discharge ports (120 ports in the discharge area) executing ink discharge are divided into plural discharge blocks (five blocks in the illustrated example) x1, x2, x3, x4, x5 and the position of the discharge ports executing ink discharge is changed in the unit of each discharge block depending on the position of the wiper 14. FIG. 5A shows a wiping state with the ink discharge from the 2nd discharge block x2 from the upstream end, and FIG. 5B shows a wiping state with the ink discharge from the 4th discharge block x4 from the upstream end.

The control as shown in FIGS. 5A and 5B for executing ink discharge only from a block where the wiper 14 passes among the blocks x1, x2, x3, x4 and x5 allows to reduce the ink consumption and to minimize the ink amount sticking to the wiper 14, thereby preventing or minimizing the ink smear in the main body of the apparatus. Since the position and passing time of the wiper 14 varies depending on the wiping speed, it is preferable, in the control method shown in FIGS. 5A and 5B, to execute control in linkage with the driving unit for the wiping (for example based on the number of pulses of a driving stepping motor).

Figure 6:
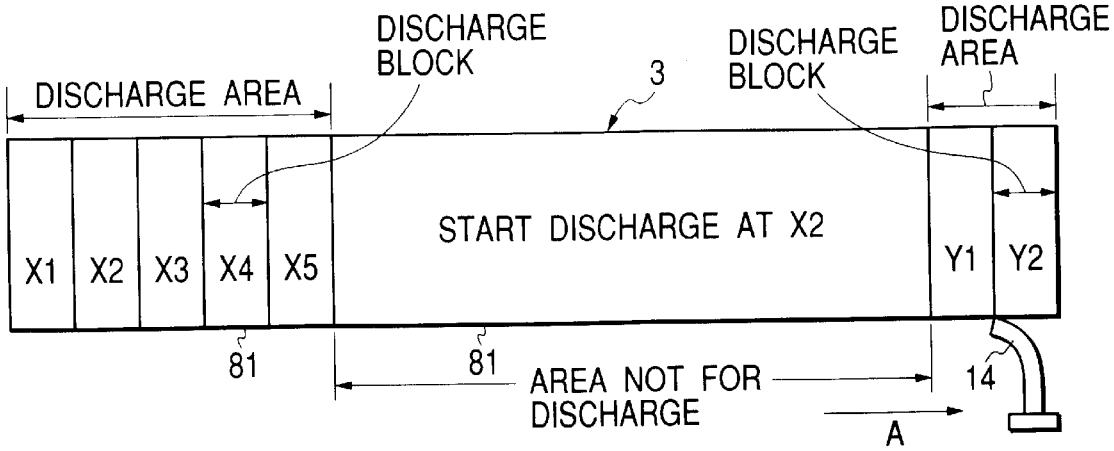
FIG. 6 is a lateral view schematically showing an example of ink discharging control method when the wiper reaches the downstream side of the array of the discharge ports in the wiping direction.
Figure 7A:
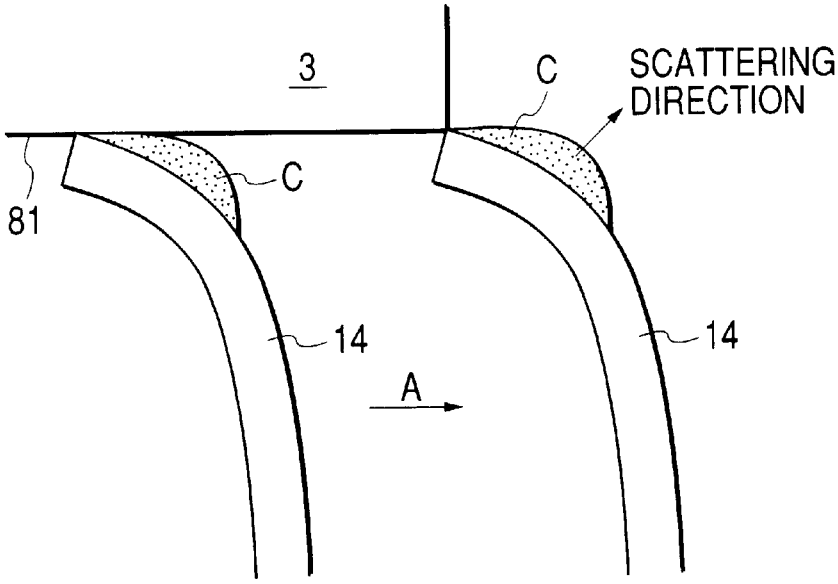
FIGS. 7A and 7B are partial lateral views showing an ink scattering state, respectively in the presence and absence of ink discharge at the downstream side, at the moment when the wiper is separated from the head upon further movement from the position shown in FIG. 6.
Figure 7B:
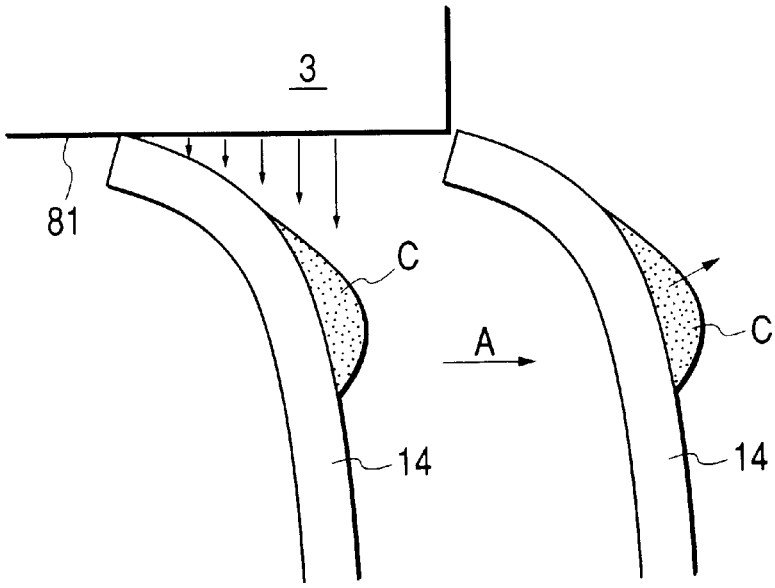

In the embodiment of the present invention, there is also executed control for positively discharging ink when the wiper (wiper blade) 14 reaches the downstream side of the discharge port array in the wiping direction. FIG. 6 is a lateral view schematically showing an example of the control method of discharging ink when the wiper 14 comes to the downstream side of the discharge port array in the wiping direction, and FIGS. 7A and 7B are partial lateral views showing the ink scattering states from the wiper at the moment when the wiper 14 leaves from the discharge port face 81 upon further movement from the position shown in FIG. 6, in the absence and presence of the ink discharge in the downstream area shown in FIG. 6. FIG. 7A shows the state in the absence of ink discharge at the downstream side, and FIG. 7B shows the state in the presence of ink discharge at the downstream side (cf. FIG. 6). In the control method shown in FIG. 6, in addition to the wiping operation shown in FIGS. 5A and 5B, a discharge area is provided in the downstream end area of the discharge port array in the wiping direction and is divided into two discharge blocks y1, y2, and, when the wiper 14 passes these discharge blocks y1, y2, ink is discharged only from a discharge block where the wiper passes.

The ink discharge in the course of the wiping operation as in the embodiment of the present invention increases the ink amount sticking to the end portion of the wiper blade 14, thereby increasing the ink scattering amount resulting from the elastic returning force of the wiper blade 14 when it is separated from the discharge port face (discharge head) and causing ink smear in the main body of the apparatus. In the embodiment of the present invention, therefore, the ink discharged is executed when the wiper blade 14 comes to the downstream side of the discharge port array in the wiping direction as shown in FIG. 6, whereby the ink (remaining ink) c sticking to the end portion of the wiper blade 14 is made to move along the wiper surface toward the base portion (downward in the drawing) as shown in FIG. 7B, thereby reducing the elastic returning force acting on the remaining ink c when the wiper 14 is separated from the head 3 (discharge port face 81) and decreasing the ink scattering amount. In the ordinary state, after wiping the head 3, the wiper 14 is cleaned with an unrepresented ink absorbent member or the like whereby the deposited abnormal substances are removed.

Figure 8:
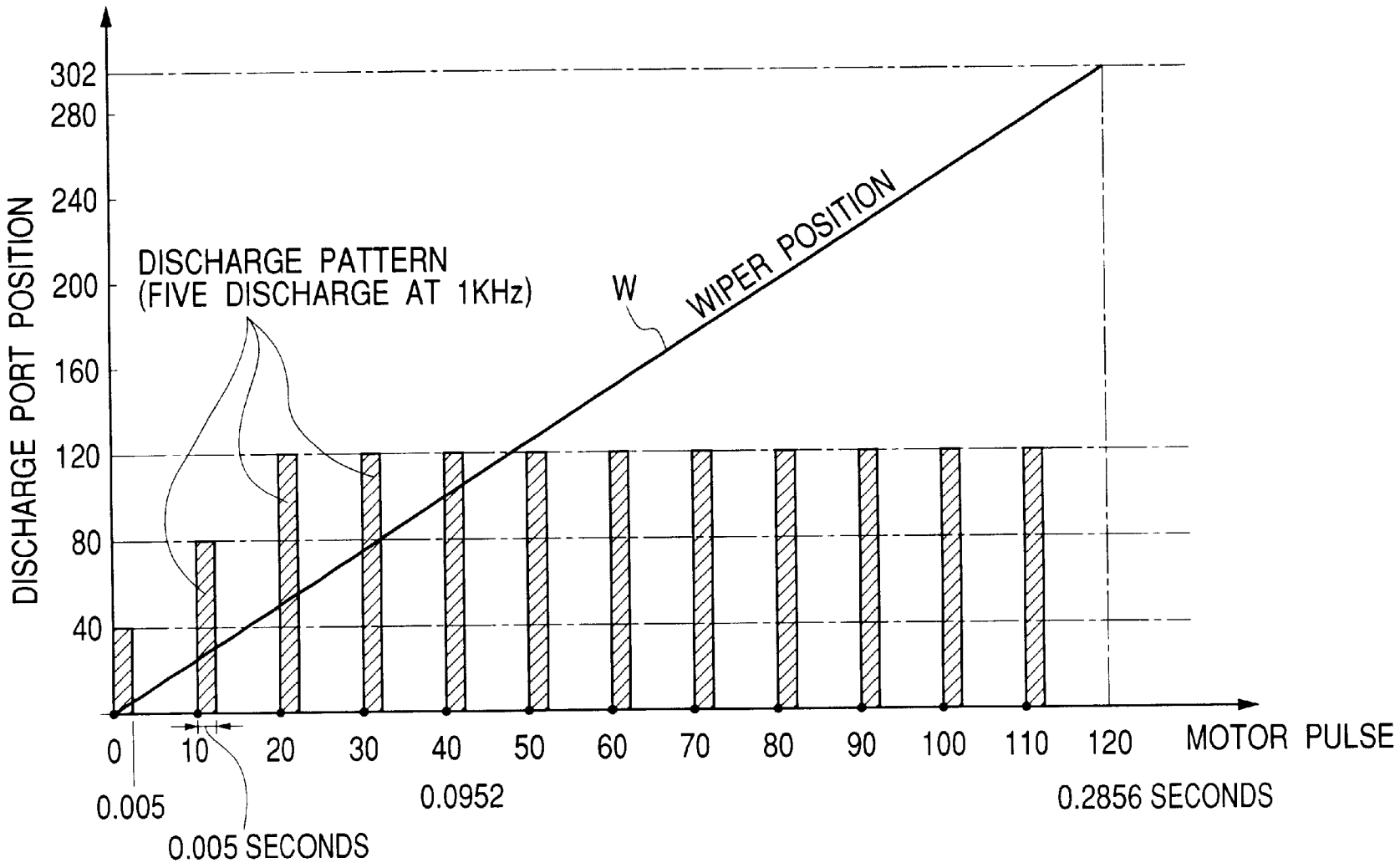
FIG. 8 is a chart showing an example of discharge pattern from the array of the discharge ports in a wiping operation, in the liquid discharge apparatus of the present invention and the discharge recovery method therefor.

FIG. 8 is a chart showing an embodiment of ink discharge from the discharge port array (an example of discharge pattern) at the wiping operation in the liquid discharge apparatus of the present invention and in the discharge recovery method therefor. In FIG. 8, the ordinate indicates the successive positions of the discharge ports from the upstream side of the discharge port array in the wiping direction, while the abscissa indicates the passing time after the wiper 14 is brought into contact with the upstream end of the discharge port array, and a line W indicates the position of the wiper 14 on the discharge port array. Also histograms in FIG. 8 indicate the positions of the discharge port executing the ink discharge (driven discharge port) corresponding to the movement (passing time or position on the discharge port array) of the wiper 14. In the embodiment shown in FIG. 8, the discharge port array is composed of 302 discharge ports arranged linearly. When the wiper 14 is brought into contact with the discharge port face (start of wiping), ink discharge is started at first with 40 discharge ports of the upstream side, and, before the wiper 14 comes into contact with the 40th discharge port, the ink discharge is started from the 40th to 80th discharge ports whereby the ink discharge is executed from 80 discharge ports in total at the upstream side.

Further, at a predetermined time prior to the contact of the wiper 14 with the 80th discharge port, the ink discharge is started from the 80th to 120th discharge ports whereby the ink discharge is executed from 120 discharge ports in total at the upstream side. Thereafter the discharge ports executing ink discharge are not added nor changed in position irrespectively of the movement of the wiper 14, so that the wiping operation of the discharge port face is executed in a state where the ink is discharge from the 120 discharge port at the upstream side in the discharge port array. In the present embodiment, in consideration of the wiping speed, the ink discharge is executed 5 times (5 droplets) from each discharge port. Also, as indicated by the histograms in FIG. 8, each discharge port executes the aforementioned ink discharge (discharge of 5 droplets at a frequency of 1 kHz) plural times in intermittent manner (with a predetermined pause therebetween) during the discharge period. The wiping speed (sliding speed of the wiper 14) is set for example at about 50 mm/sec.

In the embodiment of the present invention, the wiping operation may also be started after applying a pulse of a level not inducing the ink discharge, in order to warm the ink in the discharge port. Pre-heating of the ink to be discharged during the wiping operation to a temperature higher than the ambient temperature facilitates re-dissolving of the viscosified or solidified ink sticking to the discharge port face 81, thereby enhancing the cleaning effect, preventing unnecessary increase of the ink consumption and reducing the ink smear in the main body of the apparatus. Also in the discharge port not executing the ink discharge, there may be applied a pulse of a level not inducing the ink discharge to heat the ink in such discharge port to a temperature higher than the ambient temperature, whereby the ink of a higher temperature is extracted from the discharge port in the wiping operation, thereby facilitating re-dissolving of the viscosified or solidified ink sticking to the discharge port face 81, thus enhancing the cleaning effect, preventing unnecessary increase of the ink consumption and reducing the ink smear in the main body of the apparatus.

In the embodiment of the present invention, the ink discharge position and the ink discharge condition at the wiping operation may also be suitably changed according to the status of the wiping operation. For example it is possible to count the number of discharged dots (number of discharges) in the course of an image forming operation and to execute the wiping operation when the count exceeds a predetermined value. When the temperature of the discharge port face 81 rises by the ink discharge, the ink droplet deposited in a position distant from the discharge port also becomes viscous or solidified, but the area enabling satisfactory cleaning by wiping can be expanded by executing the wiping operation with the ink discharge from the discharge ports of the upstream side in the wiping direction when the count of the discharged dots exceeds the predetermined value. Also in such case, there may be applied a pulse of a level not inducing ink discharge to warm the ink in the discharge port, whereby ink of a temperature higher than the ambient temperature can be extracted from the discharge port at the wiping operation, thereby facilitating re-dissolving of the viscosified or solidified ink sticking to the discharge port face 81, thus enabling further improved cleaning and expanding the area of satisfactory cleaning.

Figure 9:
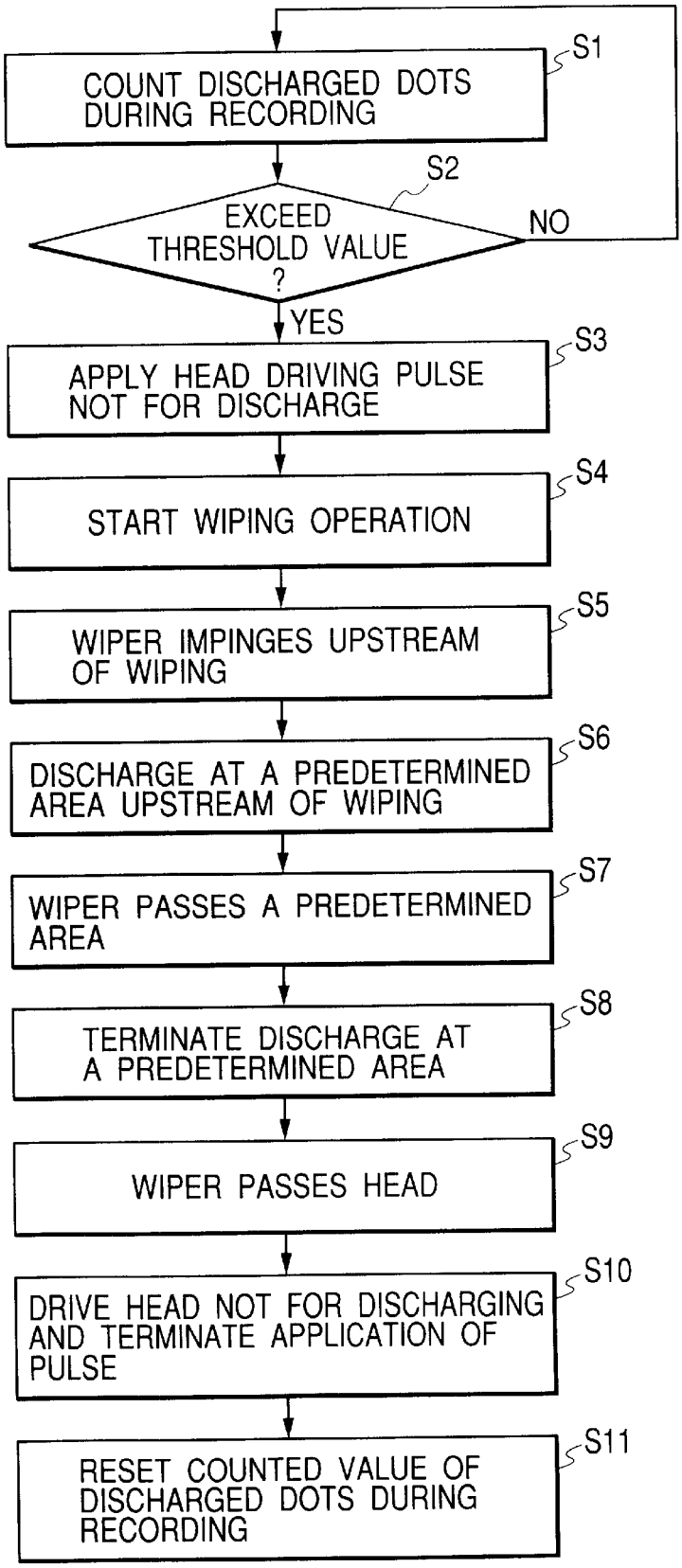
FIG. 9 is a flow chart showing an example of the operation sequence for executing the wiping operation in case the number of the discharged dots during image formation exceeds a predetermined value.

FIG. 9 is a flow chart showing an operation sequence, as explained in the foregoing, of counting the number of dots discharged (number of discharges) in the course of an image forming operation and executing the wiping operation in case the count exceeds a predetermined value. Referring to FIG. 9, a step S1 counts the number of discharged dots in the course of a printing operation, then a step S2 discriminates whether the count exceeds a threshold value, and, if the threshold value is exceeded, a step S3 applies a head driving pulse of a level not inducing ink discharge. Then a step S4 starts a wiping operation, then a step S5 enters the wiper 14 in a position at the upstream side, in the wiping direction, of the discharge port array of the head 3, and a step S6 executes ink discharge from the discharge ports in a predetermined area (discharge area) at the upstream side in the wiping direction. When a step S7 identifies that the wiper 14 has passed a predetermined discharge area, a step S8 terminates the ink discharge in the aforementioned discharge area. Then a step S9 identifies that the wiper 14 has passed the head 3 (discharge port face 81), a step S10 terminates the application of the head driving pulse of a level not inducing ink discharge, started in the step S3. Then a step S11 resets the count of the discharged dots in the printing operation, whereby the wiping operation is completed.

Figure 10:
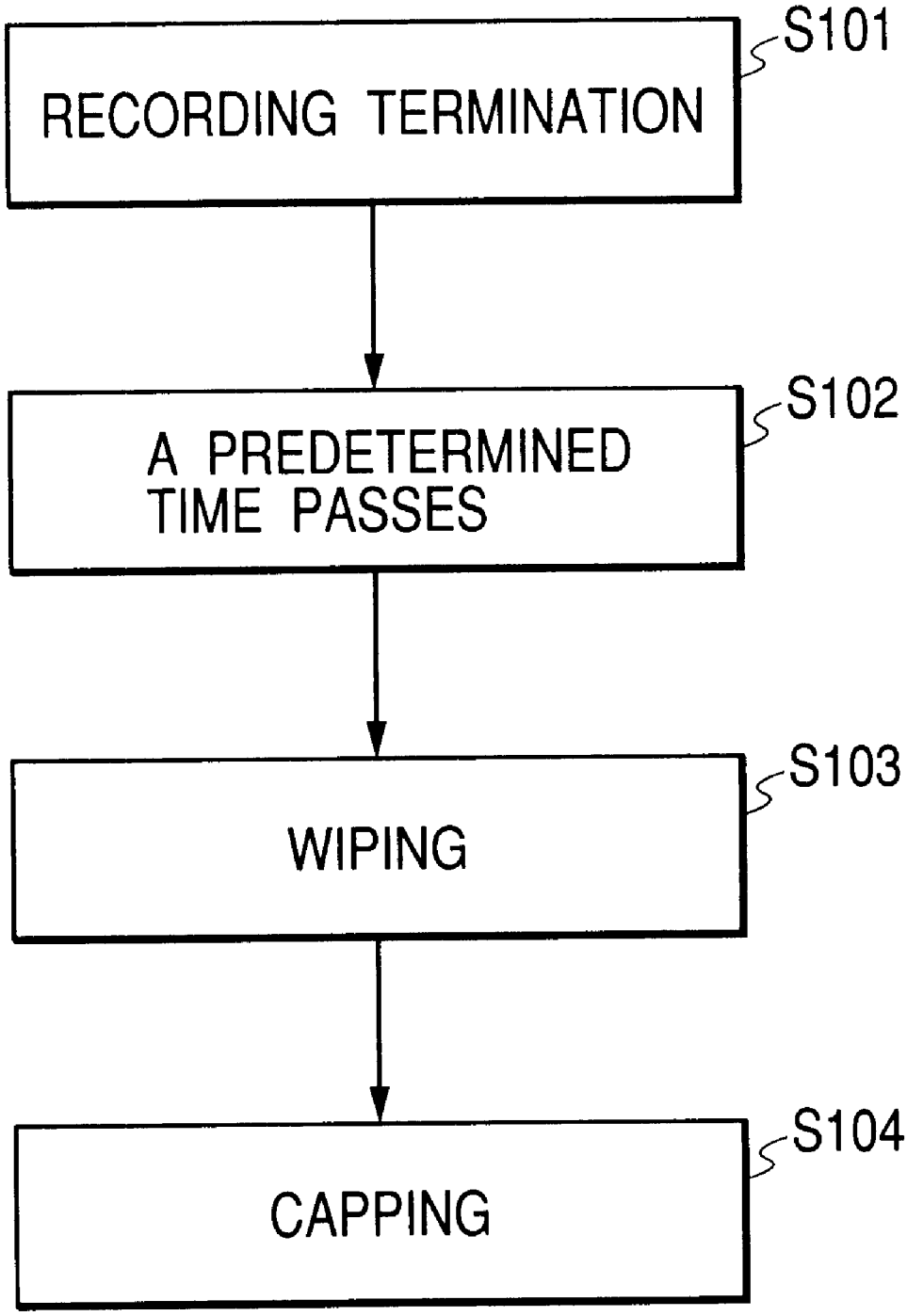
FIG. 10 is a flow chart showing an example of the operation sequence for executing the wiping operation prior to the capping operation after the end of recording.

Also in case of executing the capping operation immediately after the image recording (printing etc.) in the ink jet recording apparatus serving as the liquid discharge apparatus, the main object of wiping is generally to eliminate the ink droplet or dusts deposited on the discharge port face prior to a pause in the operation, so that the ink discharge is usually not required in the wiping operation. FIG. 10 is a flow chart showing the operation sequence in case of executing the capping operation immediately after the end of recording. Referring to FIG. 10, after the image formation (recording) is terminated in a step S101 and after the lapse of a predetermined time in a step S102, a step S103 executes wiping, and, after the end of the wiping operation, a step S104 executes capping whereby the recording apparatus is maintained in a waiting state (it may also be left in storage).

In case the ink jet recording apparatus serving as the liquid discharge apparatus is left to stand for a predetermined time, since the ink remaining on the discharge port face 81 generally becomes viscous by standing, it is necessary to execute capping after the cap is opened for example for re-starting the recording. In such case, as explained in the foregoing embodiment, the wiping operation is executed with ink discharge at least from the discharge ports at the upstream side (upstream area) in the wiping direction, in order to expand the area enabling satisfactory cleaning. Furthermore, in case the viscosity increase of ink also occurs in the interior of the head (interior of liquid discharge means), the wiping operation is executed after warming the ink in the discharge port by applying a pulse of a level not inducing ink discharge, whereby the cleaning of the discharge port face can be executed more satisfactorily. It is also preferable to discharge ink from all the discharge ports (all the discharge port array) during the passing of the wiper blade 14, thereby enhancing the cleaning effect (effect of wiping) in the vicinity of the discharge ports.

Figure 11:
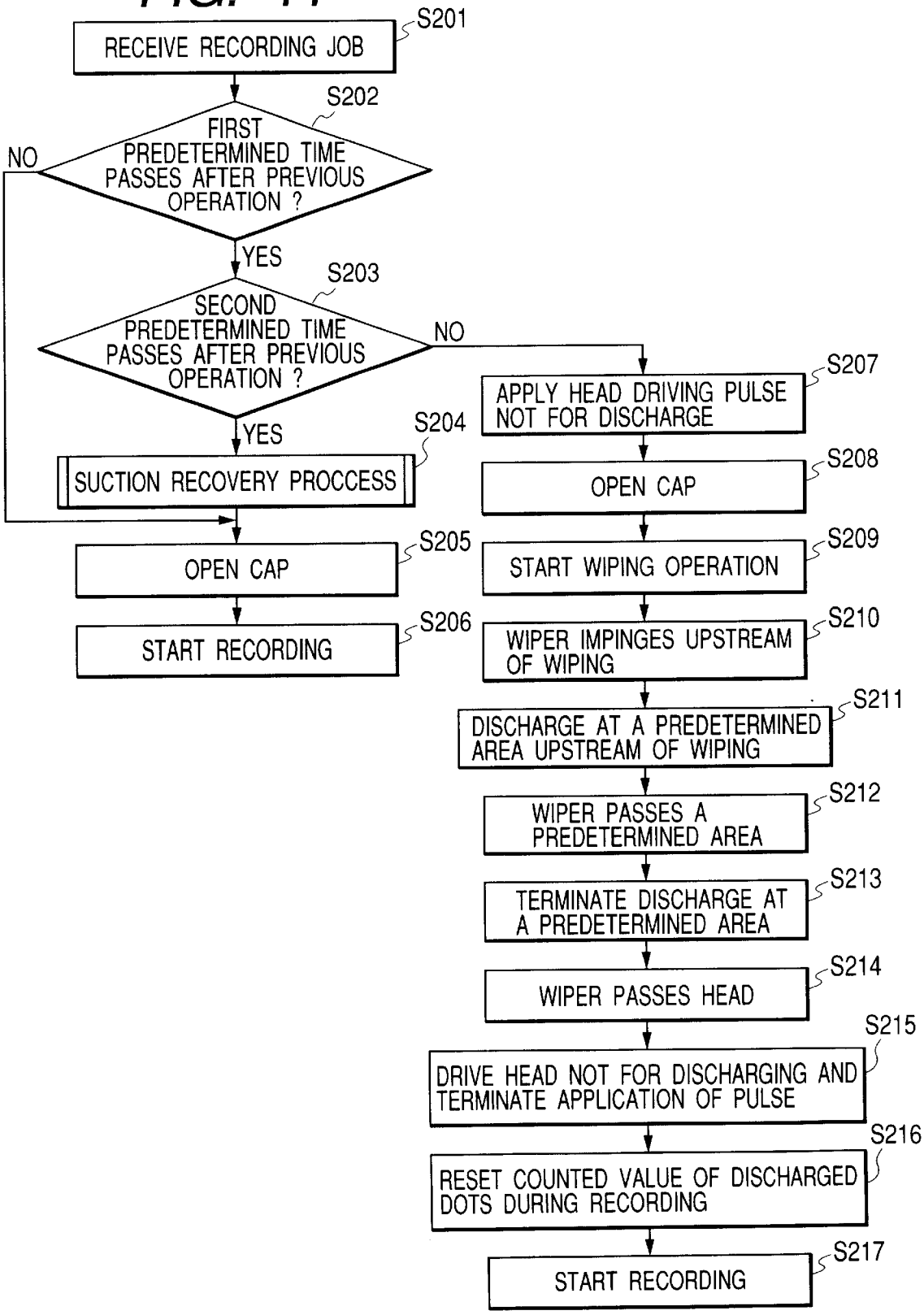
FIG. 11 is a flow chart showing an example of the operation sequence for executing the wiping operation after the cap is opened for example when the recording operation is re-started after a pause for a predetermined time.

FIG. 11 is a flow chart showing the sequence of a wiping operation in case of executing the wiping operation after the cap is opened, for example at the re-start of recording after a pause for a predetermined time. Referring to FIG. 11, when a step S201 receives the information of an image recording job, a step S202 discriminates whether a time exceeding a first predetermined time has elapsed after the previous cleaning operation. If the first predetermined time has not yet elapsed, the sequence jumps to a step S205 to open the cap and a step S206 starts the image recording. If the step S202 identifies that the first predetermined time has elapsed, a step S203 discriminates whether a time exceeding a second predetermined time has elapsed after the previous cleaning operation. If the second predetermined time has elapsed, a step S204 executes a suction recovery process for refreshing the ink in the discharge ports by sucking the ink from all the discharge ports by a suction pump or the like in the capped state, then a step S205 opens the cap and a step S206 starts the image recording.

In case the step S202 identifies that the first predetermined time has elapsed but the step S203 identifies that the second predetermined time has not elapsed, the sequence proceeds to a step 207 for applying a head drive pulse of a level not inducing the ink discharge to all the discharge ports constituting the discharge port array, then a step S208 opens the cap and a step S209 starts the wiping operation. After the start of the wiping operation, a step S210 puts the wiper 14 into a portion of the discharge port face 81 at the upstream side in the wiping direction, and a step S211 executes ink discharge in a predetermined area (discharge ports in a predetermined area) of the discharge port array at the upstream side in the wiping direction. Then, when a step S212 identifies that the wiper 14 has passed the aforementioned predetermined area, a step S213 terminates the ink discharge in such predetermined area. When a step S214 detects that the wiper has passed, by the relative movement thereof, the ink discharge head, a step S215 terminates the application of the pulse of a level not inducing the ink discharge, then a step S216 resets the count of the discharged dots during the image recording, and a step S217 starts the image recording.

When the head is mounted for the first time on the ink jet recording apparatus or the like serving as the liquid discharge apparatus, a wiping operation may be executed in order to eliminate the liquid (ink) remaining on the discharge port face immediately after the liquid (clear ink or ink) is extracted from the head by a pump. Since the liquid (for example clear ink) filled in the head may be contaminated by impurities (for example additives of sealant or adhesive coming into contact with the liquid) because of exposure to harsh environment during the transportation, it is necessary to prevent the liquid, possibly contaminated by the impurities, from remaining in the contact portion between the wiper blade and the discharge port face, and, for this purpose, there is executed in an embodiment of the present invention an operation of extracting the liquid from the head by a sufficient sucking operation so as that such liquid does not remain in the contact portion between the blade and the discharge port face and then wiping the discharge port face with the wiper blade under ink discharge thereby washing off the liquid sticking to the wiper blade.

Figure 12:
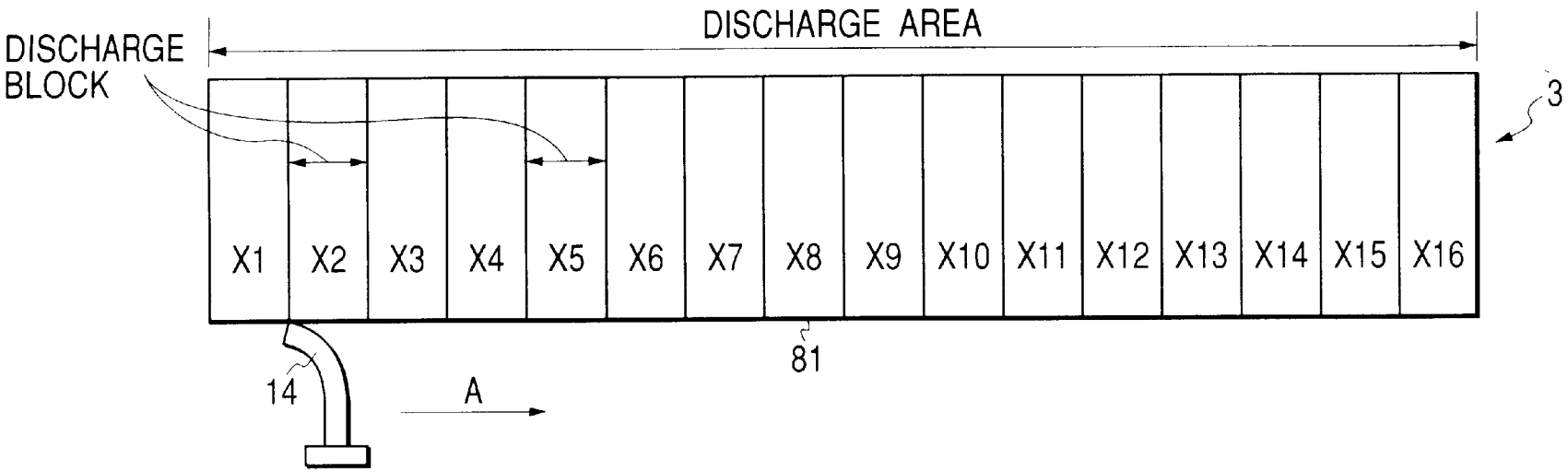
FIG. 12 is a schematic lateral view showing a wiping operation for the discharge port face immediately after the liquid is extracted from a head mounted for the first time.

FIG. 12 is a schematic lateral view explaining the wiping operation for eliminating the liquid remaining on the discharge port face, immediately after the ink is extracted from the head by the pump at the head mounting for the first time. The wiping operation shown in FIG. 12 in case of head mounting for the first time is so controlled that the position of the discharge ports executing ink discharge is changed in succession in the unit of a block according to the position of the wiper 14 (wiping position). Referring to FIG. 12, the discharge area covers all the area of the discharge port array formed on the discharge port face 81, and such discharge port array is divided into plural discharge blocks (x1, x2, x3, . . . , xi, . . . , x15, x16), and the wiping operation with the movement of the wiper 14 in a direction A is executed with ink discharge in each discharge block xi. FIG. 12 shows the wiping operation in a state where the ink discharged from a 2nd block x2 from the upstream end.

The ink discharge only from a block where the wiper 14 passes among the plural discharge blocks (x1, x2, . . . , xi, . . . , x15, x16) as shown in FIG. 12 allows to reduce the ink consumption and to minimize the ink amount sticking to the wiper 14, thereby preventing or minimizing the ink smear in the main body of the apparatus. Since the position and passing time of the wiper 14 varies depending on the wiping speed also in the control shown in FIG. 12, it is preferable to execute control in linkage with the driving unit for the wiping (for example based on the number of pulses of a driving stepping motor).

Also in the ink jet recording apparatus serving as the liquid discharge apparatus, there may be adopted a control method of counting the number of discharged dots during an image recording and executing the suction recovery process in case the count exceeds a predetermined value, or executing the suction recovery process after standing for a predetermined time. In such control, the ink is filled in the cap by the suction operation and the smear or viscosified ink on the discharge port face can be sufficiently wetted by such filled ink, so that the discharge port face can be satisfactorily cleaned even without the ink discharge during the wiping operation.

Also in the ink jet recording apparatus serving as the liquid discharge apparatus, for example in a color recording apparatus, the discharge ports (discharge port arrays) for discharging plural liquids (inks) of different physical properties may be provided within the discharge port face of a same head. The wiping operation on such head can be more satisfactorily by varying the liquid discharge condition according to the liquid discharge port where the wiper passes.

The switching of the discharge condition may be executed in the following manner. Firstly, the wiping operation is executed after reducing the viscosity of the liquid by applying a pulse of a level not inducing liquid discharge in the liquid of a high viscosity. Secondly, if a dye ink and a pigment ink are mixedly present within an array of the discharge ports, the wiping operation is executed from the side of the pigment ink, and the ink is discharged at the wiping of the side of the dye ink, in order to wash off the pigment ink tending to stick to the wiper blade 14. Thirdly, if mutually reactive plural liquids are mixedly present within an array of the discharge ports, the liquid discharge frequency in the course of the wiping operation is increased toward the liquid at the downstream side in the wiping direction, thereby preventing the reactive liquid from entering the discharge port.

Figure 13A:
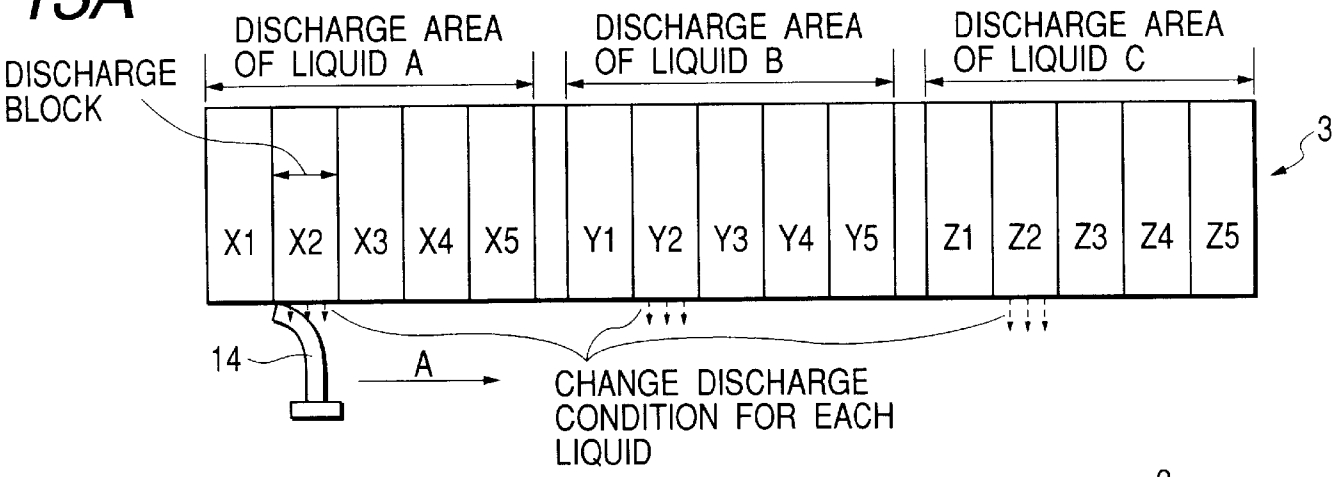
FIGS. 13A and 13B are respectively a longitudinal cross-sectional view and an elevation view showing a wiping operation on a discharge port face of a head having plural arrays of the discharge ports.
Figure 13B:
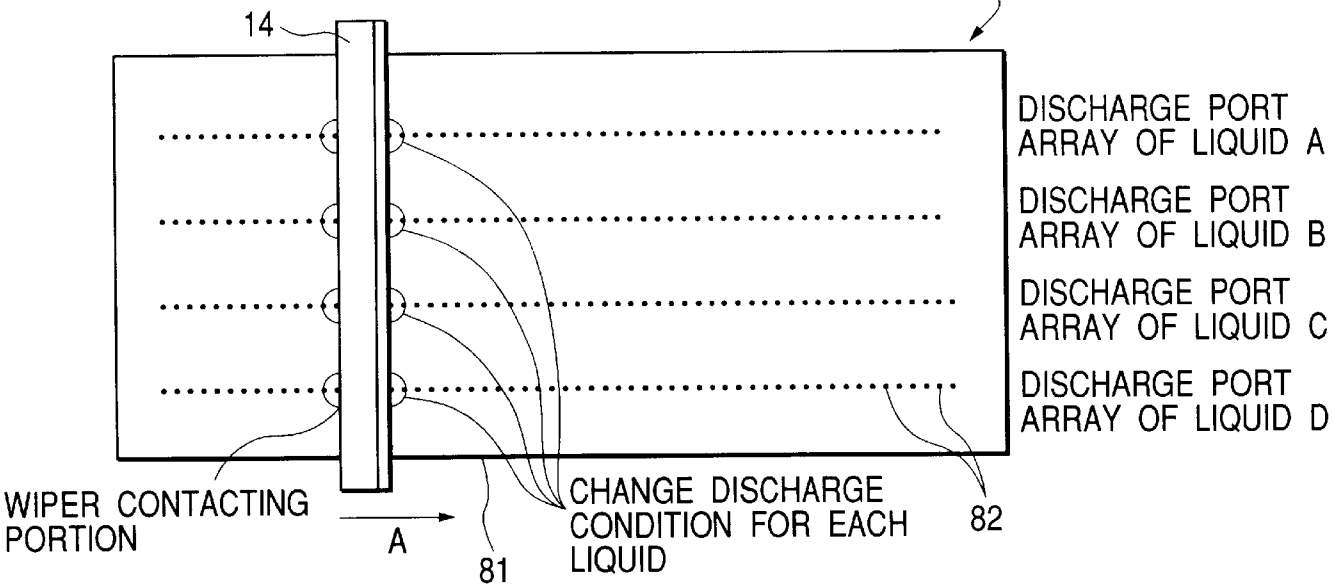

FIGS. 13A and 13B are respectively a longitudinal cross-sectional view and a elevation view, showing the discharge port face, of liquid discharge means (recording means) executing control so as to vary the liquid discharge condition according to the liquid portion where the wiper 14 passes, in case discharge ports (discharge port arrays) for discharging plural liquids (inks) of different physical properties are arranged in the discharge port face of a same head as in an ink jet recording apparatus. As shown in FIG. 13B, the discharge port face 81 is provided, respectively corresponding to different plural (four) kinds of liquids (liquid A, liquid B, liquid C, liquid D), with plural discharge port arrays for discharging respective liquids (liquid A discharge port array, liquid B discharge port array, liquid C discharge port array and liquid D discharge port array).

On the other hand, as shown in FIG. 13A, all the discharge ports constituting each discharge port array are divided into plural (three) discharge areas along the wiping direction A, and each discharge area is divided into plural discharge blocks. In the illustrated example, each discharge port array is divided, from the upstream side in the wiping direction, into a liquid A discharge area, a liquid B discharge area and a liquid C discharge area, and the liquid of corresponding kind is discharged when the wiper 14 passes each of these discharge areas. Each discharge area is further divided into plural discharge blocks, and the timing of liquid discharge according to the wiper position is controlled for each discharge block. More specifically, the liquid A discharge area is divided into discharge blocks x1, x2, x3, x4 and x5, while the liquid B discharge area is divided into discharge blocks y1, y2, y3, y4 and y5, and the liquid C discharge area is divided into discharge blocks z1, z2, z3, z4 and z5, and the wiping of the discharge port face 81 is executed by changing the discharge position in the unit of each discharge block from the upstream side in the wiping direction, according to the position of the wiper 14.

In the foregoing embodiments, there has been explained a wiping operation executed by the movement of the wiper 14 along the discharge port face 81 (recording head 3), but it is also possible to move the discharge port face relative to the wiper. The present invention is applicable to and includes any case where the wiper and the discharge port face execute a relative movement.

Also in the foregoing embodiments, there has been explained, as an example, the liquid discharge apparatus of serial recording type in which the recording is executed by a movement of the ink jet recording head 3 relative to the recording medium (recording material) P, but the present invention is likewise applicable to the liquid discharge apparatus of line recording type in which the recording is executed by sub scanning only, utilizing an ink jet recording head of line type of a length covering the entire width of the recording medium or a part thereof, with similar effects. The present invention is also applicable a liquid discharge apparatus employing a single head, a color liquid discharge apparatus employing plural heads for recording with different colors, a gradation liquid discharge apparatus employing plural heads for recording with different densities of a same color, or a liquid discharge apparatus executing the image recording by combining the foregoing, with similar effects.

Furthermore, the present invention is applicable, with similar effects, to any configuration of the head and the ink tank, such as a configuration employing a replaceable ink cartridge in which the head and the ink tank are integrally combined, or a configuration in which the head and the ink tank are separated and are mutually connected by an ink supply tube. Also the present invention is applicable to an ink jet recording apparatus employing image recording means utilizing an electromechanical converting member such as a piezoelectric element, but brings about a particularly excellent effect in an ink jet recording apparatus employing recording means of a system executing ink discharge utilizing thermal energy, because such system can attain high density and high definition of the recording.

What is claimed is:

1. A liquid discharge apparatus comprising:

an energy generating element for generating energy to be utilized for discharging liquid;

a wiper for wiping in succession plural discharge ports for discharging liquid, utilizing the energy generated by said energy generating element; and control means for starting liquid discharge, utilizing the energy generated by said energy generating element, among said plural discharge ports, in succession from a discharge port immediately prior to being wiped by said wiper and from a discharge port in a vicinity of said immediately prior to being wiped discharge port at a downstream side in a wiping direction by said wiper.

2. An apparatus according to claim 1, wherein said control means starts liquid discharge, among said plural discharge ports, in succession from the discharge ports in an upstream area in said wiping direction.

3. An apparatus according to claim 1, wherein said control means executes liquid discharge, among said plural discharge ports, in those of a downstream area in said wiping direction.

4. An apparatus according to claim 1, wherein said control means starts liquid discharge in succession from plural groups which are formed by dividing all said plural discharge ports or a part thereof.

5. An apparatus according to claim 1, wherein said energy generating element is an electrothermal converting member for generating thermal energy.

6. An apparatus according to claim 5, wherein liquid is discharged from the discharge port, utilizing film boiling generated in the liquid by thermal energy generated by said energy generating element.

7. A discharge recovery method for a liquid discharge apparatus, the method comprising:

a wiping step of wiping in succession plural discharge ports for discharging liquid with a wiper, utilizing the energy generated by an energy generating element for generating energy to be utilized for discharging liquid; and a discharge step of starting liquid discharge, utilizing the energy generated by said energy generating element, among said plural discharge ports, in succession from a discharge port immediately prior to being wiped by said wiper and from a discharge port in a vicinity of said immediately prior to being wiped discharge port at a downstream side in a wiping direction by said wiper.

8. A method according to claim 7, wherein said discharge step starts liquid discharge, among said plural discharge ports, in succession from the discharge ports in an upstream area in said wiping direction.

9. A method according to claim 7, wherein said discharge step executes liquid discharge, among said plural discharge ports, in those of a downstream area in said wiping direction.

10. A method according to claim 7, wherein said discharge step starts liquid discharge in succession from plural groups which are formed by dividing all said plural discharge ports or a part thereof.

* * * * *